US007559754B2

(12) United States Patent
Miyake et al.

(10) Patent No.: US 7,559,754 B2
(45) Date of Patent: Jul. 14, 2009

(54) INTERNAL GEAR PUMP IN COMBUSTION ENGINE

(75) Inventors: Hitomi Miyake, Miki (JP); Ichiro Uemura, Kobe (JP); Tetsuhiro Yamakawa, Maryvill, MO (US)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 11/159,584

(22) Filed: Jun. 23, 2005

(65) Prior Publication Data

US 2006/0292024 A1 Dec. 28, 2006

(51) Int. Cl.
*F04C 18/00* (2006.01)
*F01C 1/02* (2006.01)

(52) U.S. Cl. ..... 418/61.3; 123/196 W

(58) Field of Classification Search ..... 418/152, 418/61.3, 171, 166, 132, 133; 184/31
See application file for complete search history.

(56) References Cited

U.S. PATENT DOCUMENTS 3,443,522 A * 5/1969 Schindler ..... 417/283
3,551,079 A * 12/1970 Brundage ..... 418/39
3,876,349 A * 4/1975 Svensson ..... 418/169
4,457,677 A * 7/1984 Todd ..... 418/61.3
4,664,228 A * 5/1987 Hashigaki et al. ..... 184/6.5
4,846,115 A * 7/1989 Ishikawa ..... 123/41.7
4,911,119 A * 3/1990 Ohno et al. ..... 123/196 W
4,974,562 A * 12/1990 Ishii et al. ..... 123/198 C
5,085,187 A * 2/1992 Black ..... 123/196 R
6,058,894 A * 5/2000 Kobayashi et al. ..... 123/41.56
6,592,348 B1 * 7/2003 Johnson ..... 418/152

FOREIGN PATENT DOCUMENTS

JP 62093432 A * 4/1987
JP 7-24566 5/1995

* cited by examiner

*Primary Examiner*—Thomas Denion
*Assistant Examiner*—Douglas J. Duff

(57) ABSTRACT

An internal gear pump (39) of the present invention includes an inner rotor (49) relatively non-rotatably mounted on one end of a pump shaft (22) driven by a crankshaft (9), and an outer rotor (50) rotatably supported by a crankcase (1) and meshed with the inner rotor (49). The pump shaft (22) has a flange (47) formed therein, which flange (47) is rotatably supported by the crankcase (1) and covers one end face of each of the inner and outer rotors (49 and 50).

4 Claims, 3 Drawing Sheets

INTERNAL GEAR PUMP IN COMBUSTION ENGINE

BACKGROUND OF THE INVENTION

1. Field of the Invention

The present invention relates to an internal gear pump employed in a combustion engine and including an externally toothed inner rotor and an internally toothed outer rotor that mesh with each other and rotate in unison with revolution of the combustion engine for circulating a lubricant oil.

2. Description of the Prior Art

As a means for circulating a lubricant oil, filled within an oil pan of the combustion engine, to lubricate various components such as a bearing employed in the engine, an internal gear pump is well known in the art. See, for example, the Japanese Utility Model Publication No. 7-24566. The internal gear pump disclosed in this patent document includes an inner rotor and an outer rotor that are accommodated within a pump housing formed integrally with a crankcase and have respective end faces covered by a cover plate used to close the pump housing. The inner rotor is drivingly coupled with a pump shaft extending through the cover plate. The pump shaft has a driven gear meshable with a crank gear. The cover plate is fixed to an open end face of the pump housing by means of a plurality of bolts to seal between the pump housing and the crankcase.

It has, however, been found that the prior art internal gear pump requires extra cover plate, bolts and sealing member for sealing off a gap between a through-hole defined in the cover plate and the pump shaft. Accordingly, not only does the number of component parts used increase, but also a complicated and time-consuming work is required to fix the cover plate, having the pump shaft rotatably extending therethrough, to the pump housing by means of the bolts and then to seal off a gap between the pump shaft and the through-hole of the cover plate.

SUMMARY OF THE INVENTION

In view of the foregoing, the present invention has been devised to substantially eliminate the foregoing problems and inconveniences inherent in the prior art internal gear pump in the combustion engine and is intended to provide an improved internal gear pump effective to minimize the number of component parts used and to enable the assemblage to be accomplished easily without requiring any complicated and time-consuming assembling work.

In order to accomplish the foregoing object, the present invention provides an internal gear pump in a combustion engine for supplying a lubricant oil to the combustion engine, which pump includes an inner rotor relatively non-rotatably mounted on one end of a pump shaft driven by a crankshaft, and an outer rotor rotatably supported by a crankcase and meshed with the inner rotor. The pump shaft has a flange formed therein, which flange is rotatably supported by the crankcase and covers one end face of each of the inner and outer rotors.

According to the internal gear pump of the present invention, the pump shaft driven by the crankshaft is formed with the flange and this flange covers one end face of each of the inner and outer rotors. Accordingly, neither the cover plate to cover the end faces of the rotors nor the bolts for securement of the cover plate, both hitherto required in the prior art internal gear pump, is needed in the practice of the present invention. Also, since the inner rotor is mounted on one end of the pump shaft provided with the flange, the flange has a sealing function, thus eliminating the need to use the hitherto required sealing member for sealing off a gap between a through-hole of the cover plate and the pump shaft extending through the through-hole. In addition, as far as assemblage of the internal gear pump is concerned, since the flange of the pump shaft can be arranged so as to cover the respective end faces of the inner and outer rotors merely by inserting the inner rotor, then supported on one end of the pump shaft, inside the outer rotor until the inner rotor meshes with the outer rotor, the assemblage of the inner gear pump of the present invention can advantageously be facilitated with a simplified work and with no tool needed to use.

In a preferred embodiment of the present invention, the pump shaft may be a vertically extending camshaft toothedly engaged with the crankshaft. In this case, the inner rotor is fixed on a lower end of this camshaft. According to this structural feature, the flange is downwardly urged by the effect of the weight of the camshaft to contact the respective upper surfaces of the inner and outer rotors and, accordingly, variation of a side clearance of each of the inner and outer rotors can be suppressed, resulting in increase of the pumping efficiency. Also, by the maximized utilization of the camshaft, which is necessarily employed in the combustion engine, as a pump shaft, the number of component parts used can advantageously be reduced to simplify the structure, thereby allowing the combustion engine to be manufactured in a compact size.

In another preferred embodiment of the present invention, the crankcase may be formed with a bearing hole or a shaft receiving hole for receiving the flange, a pump chamber positioned below the shaft receiving hole and having a diameter smaller than that of the shaft receiving hole, and suction and discharge ports positioned below the pump chamber and fluid connected with the pump chamber. Since the shaft receiving hole, the pump chamber and the suction and discharge ports can be formed integrally with a bottom portion of the crankcase by molding, the number of component parts used and the manufacturing cost can advantageously be reduced.

In a further preferred embodiment of the present invention, the inner rotor may be made of a synthetic resin and may have an inner peripheral surface formed with a plurality of ribs that protrude in a radially inward direction and are adapted to be held in tight contact with an outer peripheral surface of the metallic camshaft. According to this structural feature, when, prior to the inner rotor being engaged with the outer rotor, the lower end of the camshaft is inserted into the inner peripheral surface of the inner rotor, the ribs on the inner peripheral surface of the inner rotor are once deformed slightly against their own elasticity, possessed by the resinous material used to form the inner rotor, by the effect of a pressing force delivered from the outer peripheral surface of the metallic camshaft. The ribs subsequently exert a restoring force to firmly contact with the outer peripheral surface of the pump shaft to allow the inner rotor to be temporarily fixed to the pump shaft in a manner immovable relative thereto. Accordingly, in this condition inserting the inner rotor inside the outer rotor from above while the camshaft is held in hand results in engagement between the inner and outer rotors, thus facilitating the assemblage of the internal gear pump.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Figure 1:
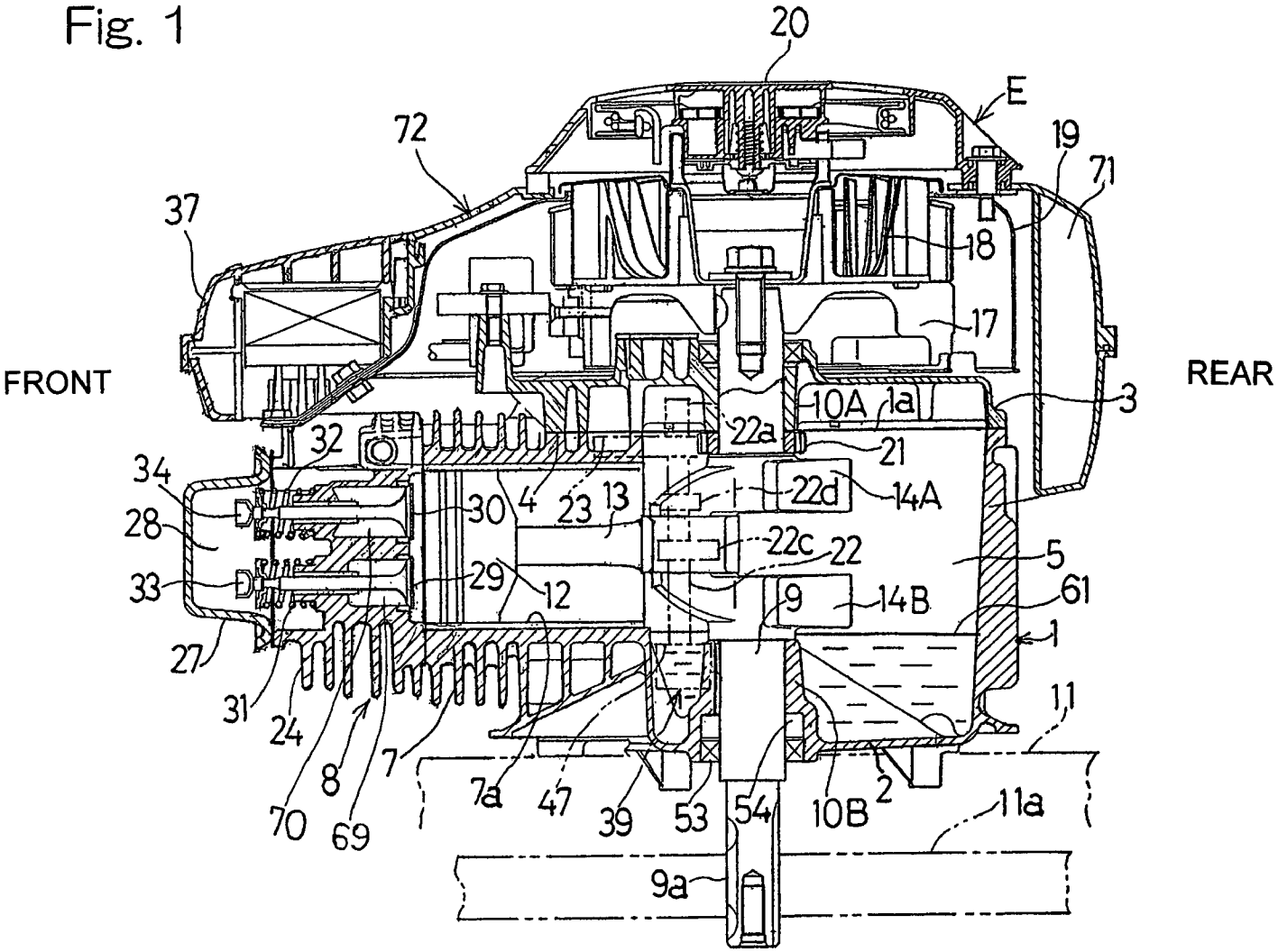
FIG. 1 is a longitudinal sectional view of an internal combustion engine employing an internal gear pump designed according to a preferred embodiment of the present invention.

A preferred embodiment of the present invention will now be described with reference to the accompanying drawings. Referring first to FIG. 1 showing, in a longitudinal sectional representation, an internal combustion engine E of a vertical shaft type employing an internal gear pump designed according to the embodiment of the present invention, the combustion engine E will be described briefly. The combustion engine E includes an engine body 8 made up of a crankcase 1 and a cylinder block 7. The crankcase 1 is formed integrally with an oil pan 2 accommodating a lubricant oil 61. A crankcase cover 3 is held in abutment with and fixed to an upper surface 1*a* of the crankcase 1, with a sealing gasket 4 intervening between it and the upper surface 1*a* of the crankcase 1. The cylinder block 7 is formed integrally with the crankcase 1 so as to protrude forwards (or leftwards as viewed in FIG. 1) of the crankcase 1.

The crankcase cover 3 is mounted on an upper surface of the engine body 8 so as to cover a top opening of the crankcase 1 and a part of the cylinder block 7. A crankshaft 9 is arranged to extend vertically through a crank chamber 5 of the crankcase 1 and is rotatably supported by the crankcase cover 3 and the crankcase 1 through upper and lower bearing portions 10A and 10B, respectively. The upper bearing portion 10A is integrally formed with the crankcase cover 3 while the lower bearing portion 10B is integrally formed with the crankcase 1. A lower end portion of the crankshaft 9 protrudes downwardly from the crankcase 1 to define an output shaft 9*a* for driving a working machine 11 such as a lawn mower. In such case, the output shaft 9*a* is connected to a cutter blade assembly 11*a* of the working machine 11.

The engine cylinder block 7 has a cylinder bore 7*a* defined therein and movably accommodating a reciprocating piston 12 in an axial direction of the cylinder bore 7*a* (or in a direction leftwards and rightwards as viewed in FIG. 1). This reciprocating piston 12 is drivingly coupled with the crankshaft 9 through a connecting rod 13 and, accordingly, the reciprocating motion of the piston 12 can be translated into a rotary motion of the crankshaft 9 through the connecting rod 13 to generate an engine output, which is utilized as a driving force to drive the working machine 11 through the output shaft 9*a* of the crankshaft 9. The crankshaft 9 has a pair of upper and lower crank webs 14A and 14B within the crank chamber 5.

An upper end portion of the crankshaft 9 opposite to the output shaft 9*a* has a flywheel 17 and a cooling fan 18 both mounted thereon for rotation together therewith. The flywheel 17 and the cooling fan 18 are both covered by a fan housing 19, which is secured to an engine cover 72 having a fuel tank 71 and an air cleaner 37 both built therein. A recoil starter 20 is fixedly mounted atop the engine cover 72. On the other hand, a crank gear 21 is fixedly mounted on a portion of the crankshaft 9 above and adjacent the upper crank web 14A.

Figure 2:
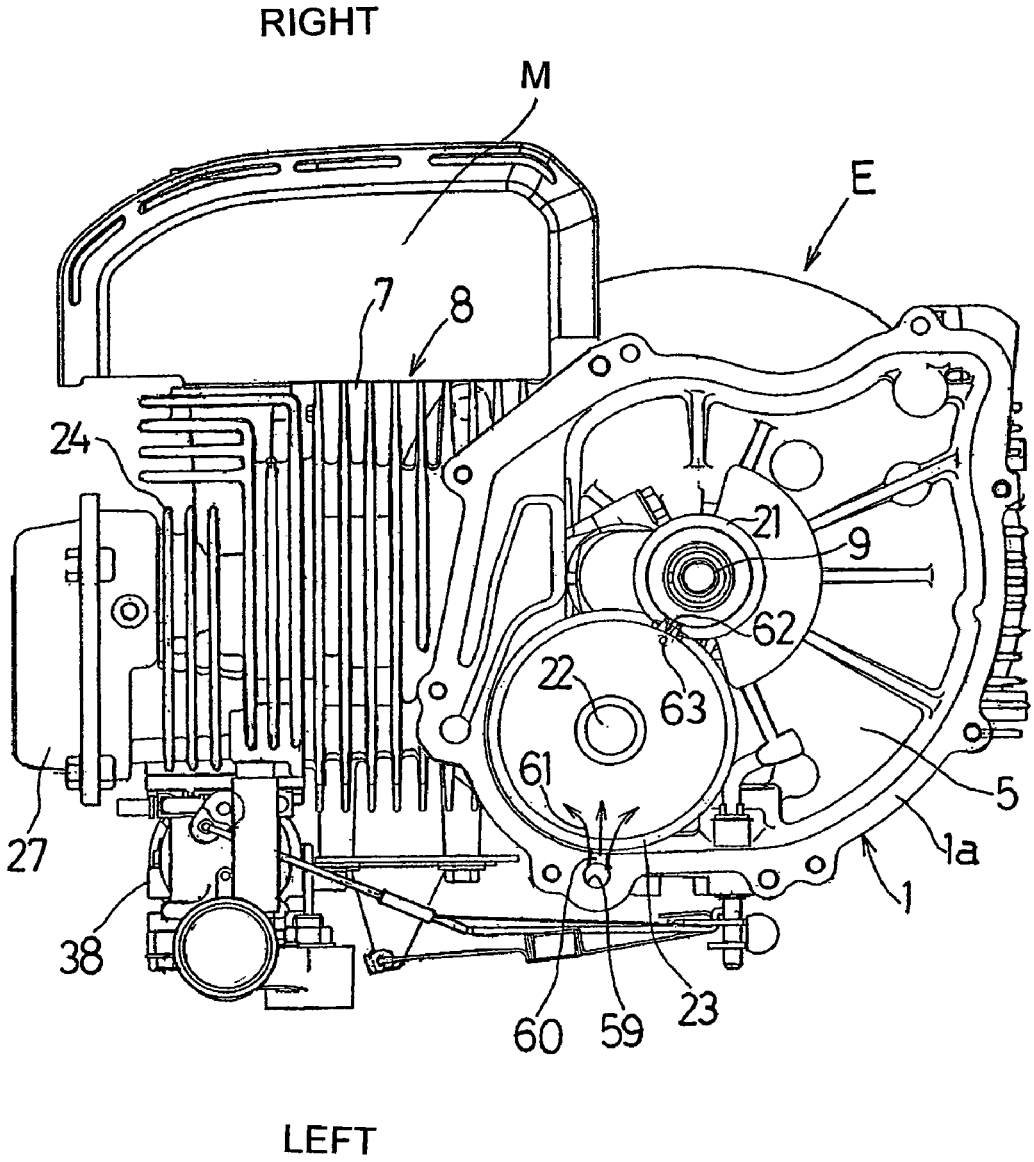
FIG. 2 is a top plan view of the combustion engine shown in FIG. 1, with a crankcase cover and an engine cover removed.

FIG. 2 illustrates a top plan view of the combustion engine E with the crankcase cover 3 and the engine cover 72 removed. Referring to FIGS. 1 and 2, the crank chamber 5 of the crankcase 1 accommodates a camshaft 22 extending parallel to the crankshaft 9. This camshaft 22 has an upper end 22*a* rotatably supported by the crankcase cover 3 and a lower end rotatably supported by the crankcase 1. This camshaft 22 has a cam gear 23 fixedly mounted thereon in the vicinity of the upper end 22*a*. The cam gear 23 is meshed with the crank gear 21 so that the rotary motion of the crankshaft 9 can be transmitted to the camshaft 22 through the meshed engagement between the crank gear 21 and the cam gear 23.

On the other hand, as shown in FIG. 1, a cylinder head 24 is connected to a free end portion of the cylinder block 7, and a rocker cover 27 is fitted to a free end portion of the cylinder head 24. This rocker cover 27 cooperates with the cylinder head 24 to define a valving chamber 28 therebetween. The cylinder head 24 supports an intake valve 29 and an exhaust valve 30, which are biased by respective springs 31 and 32 to close intake and exhaust ports 69 and 70 and are driven to open the ports 69 and 70 of the cylinder head 24 by the rocking motions of respective rocker arms 33 and 34 accommodated within the valving chamber 28. The rocker arms 33 and 34 are driven through associated tappets and pushrods (both not shown) that are driven by cams 22*c* and 22*d* formed on the camshaft 22, as the camshaft 22 is rotated in unison with the crankshaft 9.

It is to be noted that the air cleaner 37 and a carburetor 38 (FIG. 2), both forming the intake system of the combustion engine E, are arranged at a front portion of the combustion engine E and at a lower left portion of the combustion engine E, respectively. A muffler M forming the engine exhaust system is arranged at a right portion of the combustion engine E.

As shown by the double-dotted broken line in FIG. 1, an internal gear pump 39 designed in accordance with the present invention is drivingly coupled with the lower end of the camshaft 22. The details of the internal gear pump 39, as viewed from rightwards in FIG. 1, are best shown in FIG. 3.

Figure 3:
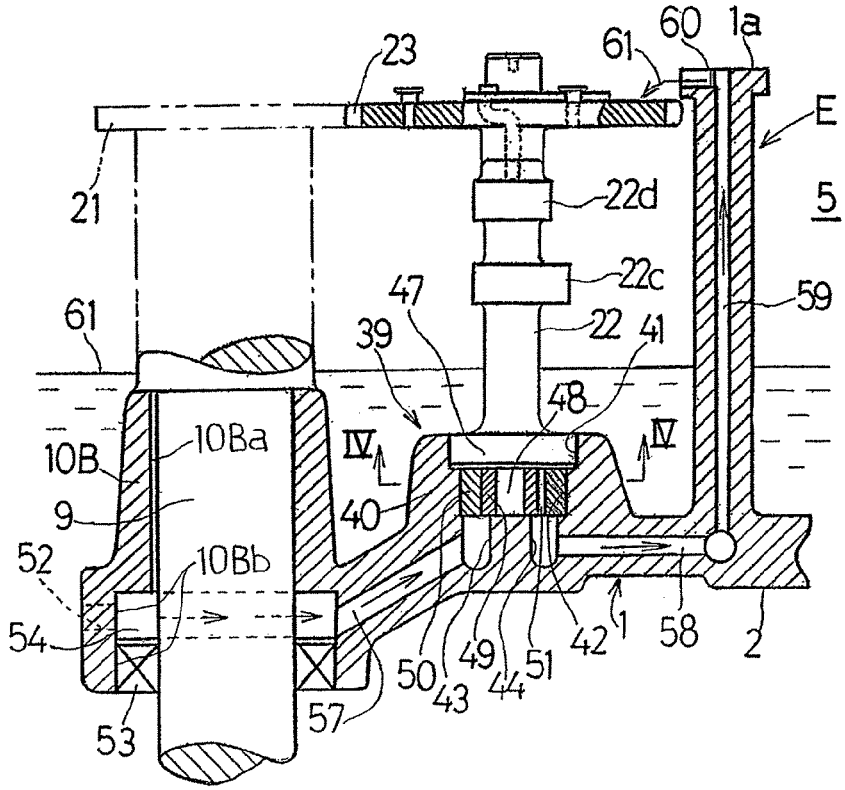
FIG. 3 is a longitudinal sectional view, on an enlarged scale, showing the internal gear pump as viewed from rightwards in FIG. 1.

Referring now to FIG. 3, a bottom portion of the crankcase 1 adjacent the lower bearing portion 10B of the crankshaft 9 is formed integrally with a pump casing 40 for the internal gear pump 39. This pump casing 40 includes therein a round-sectioned bearing hole or a shaft receiving hole 41, a pump chamber 42 of a round sectional shape having a diameter smaller than that of the shaft receiving hole 41 and formed below the shaft receiving hole 41 in coaxial relation with the shaft receiving hole 41, and suction and discharge ports 43 and 44 formed below the pump chamber 42 for fluid connection with the pump chamber 42.

The lower end of the camshaft 22 is formed integrally with a round flange 47 and a pump drive shaft 48 protruding downwardly from the flange 47. The pump drive shaft 48 is inserted into the pump chamber 42 with the round flange 47 rotatably nested into the bearing hole 41. In other words, the lower end of the camshaft 22 is rotatably supported within the bearing hole 41 in the pump casing 40 through the round flange 47.

Figure 4A:
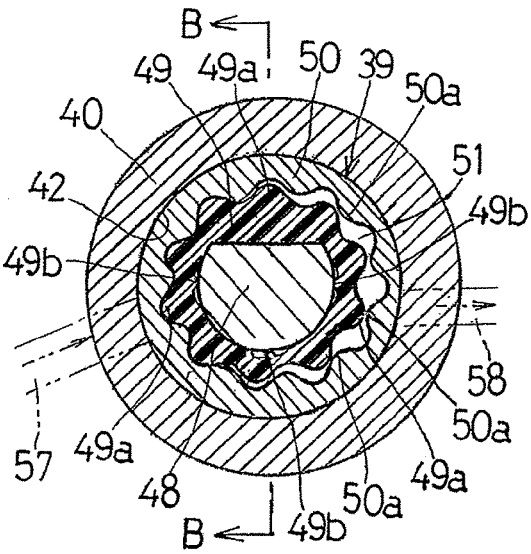
FIG. 4A is a cross-sectional view taken along the line IV-IV in FIG. 3, showing the internal gear pump on an enlarged scale.

The externally toothed inner rotor 49 is supported around the pump drive shaft 48 integral with the camshaft 22 in non-rotatable relation to the pump drive shaft 48 and is accommodated within the pump chamber 42 together with the internally toothed outer rotor 50 so that the rotors 49 and 50 mesh with each other. Specifically, as shown in FIG. 4A showing a cross-section taken along the line IV-IV in FIG. 3, the inner and outer rotors 40 and 50 have their respective external and internal teeth 49*a* and 50*a* which are meshed with each other within the pump chamber 42.

It is, however, to be noted that while the outer rotor 50 is mounted rotatable relative to an inner peripheral surface of the round-sectioned pump chamber 42, the inner rotor 49 supported by the pump drive shaft 48 is positioned to be eccentric relative to the inner peripheral surface of the pump chamber 42, that is, the inner rotor 49 does not share the common center with the circle described by the inner peripheral surface of the pump chamber 42. Accordingly, at a location opposite to the point of engagement between the inner and outer rotors 49 and 50, some of the external teeth 49*a* and some of the internal teeth 50*a* do not mesh with each other, leaving a gap 51 therebetween, as shown in FIG. 4A.

Each of the inner and outer rotors 49 and 50 is a molded product made of a synthetic resin. In particular, the inner rotor 49 has an inner peripheral surface defining a center hole. This center hole is of a non-circular sectional shape with a portion of the circle cut out. The pump drive shaft 48 having a sectional shape complemental to the non-circular sectional shape of the inner peripheral surface of the inner rotor 49 is inserted into the center hole in the inner rotor 49 to allow the inner rotor 49 to be driven together with the pump drive shaft 48. Accordingly, rotation of the inner rotor 49 together with the pump drive shaft 48 is accompanied by a corresponding rotation of the outer rotor 50 as some of the external teeth of the inner rotor 49 are meshed with some of the internal teeth of the outer rotor 50.

Figure 4B:
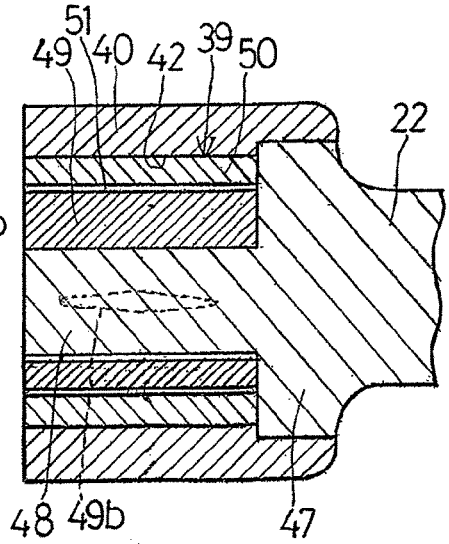
FIG. 4B is a cross-sectional view taken along the line B-B in FIG. 4A.

The inner peripheral surface of the inner rotor 49 is formed with a plurality of, for example, three elastic ribs 49*b* spaced an equal distance from each other in a circumferential direction thereof and protruding towards the pump drive shaft 48 in a radially inward direction thereof. As shown in FIG. 4B showing a cross-section taken along the line B-B in FIG. 4A, each of the ribs 49*a* is of an axially elongated triangular sectional shape having a vertex oriented towards the longitudinal axis of the inner rotor 49 at an axially intermediate point of the inner peripheral surface of the inner rotor 49. Accordingly, the pump drive shaft 48 can be inserted into the center hole of the inner rotor 49 in either direction.

Since the three elastic ribs 49 are formed integrally with the inner peripheral surface of the inner rotor 49, when the pump drive shaft 48 is press-fitted into the center hole of the inner rotor 49 so that the inner rotor 49 can be supported on an outer peripheral surface of the pump drive shaft 48, the three elastic ribs 49*b* are once deformed slightly against the elasticity, possessed by the resinous material used to form the inner rotor 49, by the effect of a pressing force delivered from the outer peripheral surface of the pump drive shaft 48 of the metallic camshaft 22. The ribs 49 subsequently exert a restoring force to firmly contact with the outer peripheral surface of the pump drive shaft 48 to thereby allow the inner rotor 49 to be temporarily fixed to the pump drive shaft 48 in a manner immovable relative thereto.

Accordingly, during assemblage of the internal gear pump 39, and particularly when the camshaft 22 having the inner rotor 49 having been temporarily fixed to the lower end thereof in the manner described above is inserted into the crank chamber 5 from above the crankcase 1 until some of the external teeth 49*a* of the inner rotor 49 are meshed with some of the inner teeth 50*a* of the outer rotor 50, the inner rotor 49 does in no way separate from the lower end of the camshaft 22, thereby facilitating the assemblage of the internal gear pump 39.

As shown in FIG. 3, the bearing portion 10B has an inner peripheral surface 10Ba for supporting the crank shaft 9 and a radially enlarged inner peripheral surface 10Bb having a diameter larger than that of the inner peripheral surface 10Ba. A gap between the enlarged inner peripheral surface 10Bb of the lower bearing portion 10B at a lower end portion thereof and the crankshaft 9 is sealed off by an annular sealing member 53. An annular oil reservoir space 54 is defined above this annular sealing member 53 and between the enlarged inner peripheral surface 10Bb and an outer peripheral surface of the crankshaft 9. The base portion of the lower bearing 10B is formed with a plurality of radially extending oil introducing ports 52 that are communicated with the oil reservoir space 54. Also, an oil suction passage 57 communicating between the suction port 43 of the internal gear pump 39 and the oil reservoir space 54 is formed in a portion of the crankcase 1 between the lower bearing portion 10B and the pump casing 40.

On the other hand, an oil discharge passage 58, communicated with the discharge port 44 of the internal gear pump 39, and an oil supply passage 59 communicated with the oil discharge passage 58 and defined in a side wall of the crankcase 11 so as to extend upwardly to the upper surface 1*a* of the crankcase 1 are formed in a portion of the crankcase 1 on one side of the internal gear pump 39 opposite to the lower bearing portion 10B. Also, at least one spray port 60 communicated with an upper end of the oil supply passage 59 is formed in the upper surface 1*a* of the crankcase 1 so that the lubricant oil supplied through the oil supply passage 59 can be sprayed therethrough onto the cam gear 23.

The operation of the internal gear pump 39 will now be described. Assuming that the combustion engine E shown in FIG. 3 is started, rotation of the crankshaft 9 is transmitted to the camshaft 22 through the crank gear 21 then meshed with the cam gear 23, causing the inner rotor 49, supported by the pump drive shaft 48 at the lower end of the cam shaft 22, to rotate together with the camshaft 22, which is in turn accompanied by rotation of the outer rotor 50 that is partly meshed with the inner rotor 49. Concurrent rotation of the inner and outer rotors 49 and 50 in the same direction with the gap 51 left therebetween results in development of a sucking force relative to the suction port 43 within the pump chamber 42, having the top opening closed by the annular flange 47.

By the action of this sucking force, the lubricant oil 61 drawn from the oil pan 2 into the oil reservoir space 54 through the oil introducing ports 52 and then from the oil reservoir space 54 into the oil suction passage 57, as shown by arrow-headed lines in FIG. 3, can be pumped through the suction port 43 into the gap 51 between the inner and outer rotors 49 and 50 within the pump chamber 42. The lubricant oil 61 can subsequently be discharged from the gap 51 into the oil discharge passage 58 through the oil discharge port 44. The lubricant oil 61 within the oil discharge passage 58 is thereafter urged to flow upwardly through the oil supply passage 59 and is then sprayed from the spray port 60 onto an upper surface of the cam gear 23 to lubricate the cam gear 23 and the crank gear 21 meshed therewith. After the gears 23 and 21 have been so lubricated, the lubricant oil 61 falls by gravity into the oil pan 2, thus completing the recirculation of the lubricant oil 61.

It is to be noted that the oil level of the lubricant oil 61 within the oil pan 2 shown in FIGS. 1 and 3 is at the time of the combustion engine E being halted and is kept at a level above the oil introducing ports 52. Since the plural oil introducing ports 52 open around the lower end portion of the lower bearing portion 10B, the lubricant oil 61 can be efficiently introduced into the oil reservoir space 54 even when the combustion engine E and, hence, the oil pan 2 is tilted in any direction.

As hereinbefore described, in this internal gear pump 39, the round flange 47 formed integrally with the camshaft 22 that is used as a pump shaft closes the top opening of the pump chamber 42 while covering respective upper end faces of the inner and outer rotors 49 and 50 and, therefore, neither the cover plate nor the bolts for securement of the cover plate, both hitherto required in the prior art internal gear pump, is needed in the practice of the present invention. Also, since the inner rotor 49 is supported by the pump drive shaft 48 formed integrally with the camshaft 22 having the round flange 47, the round flange 47 has a sealing function, thus eliminating the need to use the hitherto required sealing member for sealing off a gap between the pump shaft and the cover plate.

In addition, with respect to the assemblage of the internal gear pump 39, the annular flange 47 can be arranged so as to cover the respective upper end faces of the inner and outer rotors 49 and 50 merely by holding the camshaft 22 with one hand and inserting the inner rotor 49, then supported on the pump drive shaft 48 integral with the camshaft 22, inside the outer rotor 50 until the inner rotor 49 meshes with the outer rotor 50. Thus, the assemblage of the internal gear pump 39 can advantageously be facilitated with a simplified work and with no tool needed to use. Yet, since in this internal gear pump 39 the camshaft 22 is formed integrally with the round flange 47 and the pump drive shaft 48 so that the camshaft 22 can be used as the pump shaft, the number of component parts used can advantageously be reduced with the structure correspondingly simplified, thereby allowing the combustion engine E to be manufactured in a compact size.

Yet, in this internal gear pump 39, the round flange 47 formed on the lower end of the camshaft 22 that extends vertically is downwardly urged by the effect of the weight of the camshaft 22 as a whole to contact the respective upper end faces of the inner and outer rotors 49 and 50 as viewed in FIG. 3 and, accordingly, variation of a side clearance of each of the inner and outer rotors 49 and 50 can advantageously be suppressed, resulting in increase of the pumping efficiency.

The vertical shaft type combustion engine E is of a structure, in which the crankcase cover 3 is secured to the top surface 1*a* of the crankcase 1. Accordingly, the camshaft 22 can be inserted from the top opening of the crankcase 1 into the interior of the crankcase 1 so that the cam gear 23 on the camshaft 22 can mesh with the crank gear 21 on the crankshaft 9. For this purpose, as shown in FIG. 2, positioning markings 62 and 63 to be aligned with each other are formed at respective predetermined locations of the crank gear 21 and the cam gear 23 so that at the time of the assemblage the cam gear 23 can be properly engaged with the crank gear 21 by orienting the camshaft 22 with respect to the direction of rotation thereof to align the positioning marking 62 with the positioning marking 63 on the crankshaft 9. By so doing, the crankshaft 9 and the camshaft 22 can cooperate in the correct relative position.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. An internal gear pump assembly in a combustion engine for supplying a lubricant oil to the combustion engine, which pump comprises:

an inner rotor relatively non-rotatably mounted on one end of a pump shaft driven by a crankshaft; and an outer rotor rotatably supported by a crankcase and meshed with the inner rotor;

said pump shaft being formed by a lower end portion of a vertical camshaft and having a flange formed integrally therein, the flange being rotatably supported by the crankcase and covering one end face of each of the inner and outer rotors;

wherein the flange is rotatably engaged directly in a shaft receiving hole defined in the crankcase, said flange directly engaged in the shaft receiving hole without an axial bearing support member intervening between the flange and the shaft receiving hole, wherein the flange and the shaft receiving hole together define a plain bearing therebetween;

wherein the camshaft is formed integrally with the flange and a pump drive shaft protruding along the axis of rotation of the camshaft and on the opposite side of the flange from the camshaft, wherein the pump drive shaft is directly engaged in a center hole defined by the inner rotor without a radial bearing support member between the flange and an end of the pump drive shaft;

wherein the crankcase has a top opening and a bottom surface formed integrally with an oil pan accommodating a lubricant oil, and the bottom surface of the crankcase is formed with the shaft receiving hole, a pump chamber positioned below the shaft receiving hole, and suction and discharge ports positioned below the pump chamber and fluidly connected with the pump chamber, the pump chamber having a diameter smaller than that of the shaft receiving hole and accommodating the inner rotor and the outer rotor; and further comprising:

a cam gear fixedly mounted on the camshaft and toothedly engaged with the crankshaft to drive the camshaft;

a cam defined in the cam shaft between the flange and the cam gear; and an oil supply passage for supplying the lubricant oil from the internal gear pump onto the cam gear, wherein the cam gear is fixedly mounted on an upper end portion of the camshaft immediately adjacent a distal end of the camshaft.

2. The internal gear pump assembly as claimed in claim 1, wherein the inner rotor is made of a synthetic resin and has an inner peripheral surface formed with a plurality of ribs that protrude in a radially inward direction and are plastically deformable to be held radially in tight contact with an outer peripheral surface of the camshaft.

3. The internal gear pump assembly as claimed in claim 2 wherein the plurality of ribs have an elongated triangular configuration in a plan view.

4. The internal gear pump assembly as claimed in claim 1, wherein the oil supply passage is defined in a side wall of the crankcase.

* * * * *